United States Patent [19]

Vinnemann et al.

[11] 4,196,601

[45] Apr. 8, 1980

[54] ENDLESS TRACK ROTATING THREAD GUIDE

[75] Inventors: Antonius Vinnemann; Heinrich K. Elsässer, both of Stuttgart; Manfred E. Walter, Grotzingen; Willi G. Gasier, Gaufelden; Werner Sommer, Esslingen; Wolfgang A. A. Brenner, Schleirbach; Hermann Kress, Filderstadt, all of Fed. Rep. of Germany

[73] Assignee: Sulzer Morat GmbH, Fed. Rep. of Germany

[21] Appl. No.: 869,512

[22] Filed: Jan. 16, 1978

[30] Foreign Application Priority Data

Jan. 17, 1977 [DE] Fed. Rep. of Germany ..... 2701652
Oct. 31, 1977 [DE] Fed. Rep. of Germany ..... 2748779

[51] Int. Cl.[2] ..... D04B 3/06
[52] U.S. Cl. ..... 66/125 R
[58] Field of Search ..... 66/125 R, 84 A, 64, 66/78, 13, 146, 131; 139/436, 224 R

[56] References Cited

U.S. PATENT DOCUMENTS

| | | | |
|---|---|---|---|
| 3,006,173 | 10/1961 | Shoaf | 66/146 X |
| 3,079,779 | 3/1963 | Butler et al. | 66/146 |
| 3,147,604 | 9/1964 | Ziemba | 66/146 X |
| 3,446,038 | 5/1969 | Inui | 66/84 A |
| 3,703,818 | 4/1972 | Umeda et al. | 66/125 R |
| 3,732,896 | 5/1973 | Jekl et al. | 139/224 R |
| 3,797,279 | 3/1974 | Kline | 66/146 X |
| 4,034,783 | 7/1977 | Pech et al. | 139/224 R |
| 4,081,001 | 3/1978 | Borodin et al. | 139/436 |

*Primary Examiner*—Werner H. Schroeder
*Assistant Examiner*—Andrew M. Falik

[57] ABSTRACT

Apparatus for feeding a plurality of yarn, sliver or fibrous materials to a textile machine, comprising: a plurality of stationary supply packages on which said materials are wound; a stationary endless track having at least a working and a return section; and a plurality of feeding elements. Every feeding element is associated with one of said supply packages, wherein said feeding elements are arranged to run around said track in series in such a manner, that the distances between the feeding elements and the associated ones of said supply packages become gradually and alternately smaller and larger during successive runs of said feeding elements on said track. Said materials are held by said feeding elements when the relevant feeding elements pass through said return section, and are releasable for processing by said textile machine when the relevant feeding elements pass through said working section. A plurality of automatically operating and stationary storage devices are arranged in the path between the said feeding elements and the associated supply packages for the intermediate storage of all quantities of the materials which may result from a reduction of the distance between a feeding element and the associated supply package, and for the delivery of said stored quantities, if said distances again become gradually larger.

18 Claims, 7 Drawing Figures

ENDLESS TRACK ROTATING THREAD GUIDE

The invention relates to an apparatus for textile machines for feeding yarn, sliver or fibrillar materials, wound on fixed supply packages, comprising at least one endless track, on which guide elements for the materials are arranged to run around in series in such a manner that the distances between the supply packages and the guide elements, while they are continously running around the track, becomes gradually larger or smaller.

In known apparatus of this type U.S. Pat. No. 3,703,818 granted Nov. 28, 1972 or in British Pat. No. 1,449,244 published Sept. 15, 1976, which are used in conjunction with warp knitting machines and flat bed or circular knitting machines, a plurality of thread guides or of thread feeling elements is envisaged to rotate in sequence on a figure of eight track and rotate continuously during the warp or weft knitting process. Since the supply packages for the yarns are mounted on fixed creels, there is a constant variation in distance between the supply packages and the relevant feeding elements, when the term "distance" is understood as being that distance from a supply package, on a straight and shortest path, bearing in mind all possible existing deflection points for the yarn, to the relevant feeding element. If this distance increases during rotation of a yarn feeding element, yarn is automatically withdrawn from the relevant supply package. On the other hand, if the distance becomes shorter, and if a yarn section, corresponding to the reduced distance is not simultaneously used up by the machine, there will be a slack loop somewhere between the supply package and the feeding element. If this occurs simultaneously with several yarns, there is the danger that the yarns will entangle with each other and that the machine will have to be stopped for a long time to rectify the fault.

This problem is particularly troublesome on knitting machines where each knitting needle is controlled individually by an eccentric cam and on which as many as sixty or more systems and hence at least 120 feeding elements could exist on each needle bed U.S. Pat. No. 4,109,491 granted Aug. 29, 1978. Expedient solutions to overcome this problem have not yet appeared in the literature and as yet, there are no knitting machines in operation which could offer suitable solutions. On the only yarn guide system made known for such knitting machines, this problem occurs, but to only a relatively small extent, since with these feeding elements with pneumatic and/or mechanical means, the yarn entanglements associated with the distance reductions are prevented. Such yarn guides are too expensive and prone to failure for a number of reasons, so that they do not represent a practical alternative to the apparatus of the type described initially. The aim of the present invention is therefore to develop the apparatus of the type mentioned initially, such that during the continuous rotation of the feeding elements, no sagging material loops can form, eventhough there may be a substantial reduction in the distance between the feeding element and its supply package acconpanied simultaneously by the absence of material being used up by the machine.

These objectives are achieved according to the characterising features wherein between the supply packages and the guide elements automatically operating storage means are arranged for the immediate storage of material quantities, if said distances become gradually smaller, wherein said stored quantities correspond to the reduction of said distances, and then to deliver said stored quantities, if said distances again become gradually larger.

The invention offers the advantage that during the said reduction in distances, the amounts of material, responsible for the formation of the loosely sagging material loops and corresponding to the reduction in distance, are automatically drawn into the storage means and stored there intermediately, so that entanglement of the yarns is no longer possible and all yarns are fed under control at all times.

Preferably, the storage means are so designed that the intermediately stored amounts of material are released again when the distance increase follows a distance decrease and before withdrawal of further material from the relevant supply package. In this manner, an additional advantage is obtained in that no material can accumulate in the storage means, which in the long term would lead to overloading of the storage means.

It is particularly advantageous to provide a clamping device at the entries to the storage means nearest the supply packages, and this clamp is activated into a clamping position shortly before commencement of an intermediate storage, for the purpose of interrupting the withdrawal of material from the relevant supply package, and the clamp is actuated automatically into an open position, shortly before completion of release of the intermediately stored material, following an increase in distance. The essential advantage of this measure is that the storage means, at those instances when a reduction in distance takes place, are filled only with material released due to the reduced distance and not filled with fresh material withdrawn from the supply package.

Other advantageous features of the invention are characterised in the sub claims. The invention will now be described in greater detail in conjunction with the attached drawings of an embodiment.

Figure 1:
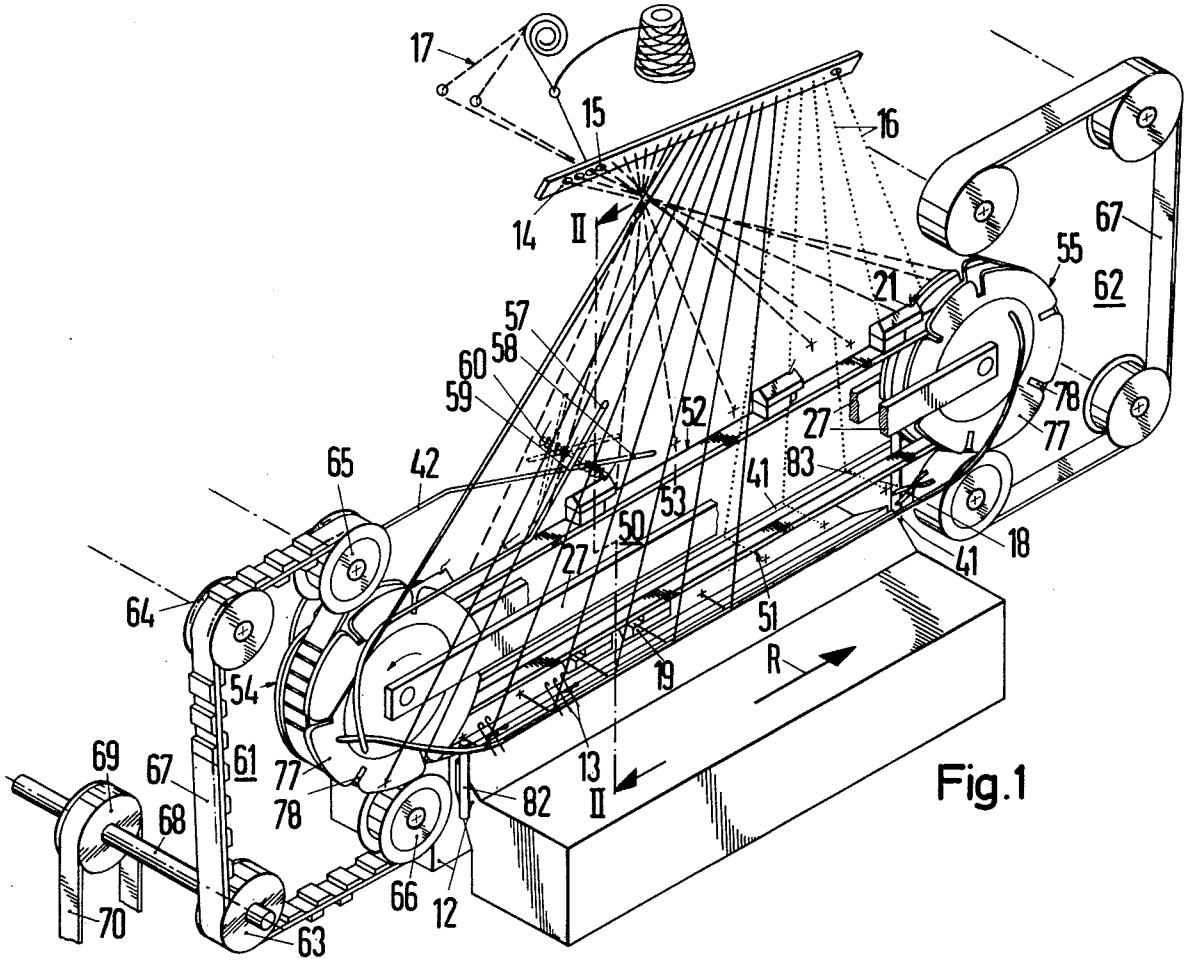
FIG. 1 shows a perspective, schematic diagram of a knitting machine particularly suitable for use with the apparatus according to the invention.

FIG. 1 shows a flat bed machine with two needle beds in V-formation, and in the tricks of which knitting needles 13 can be moved to and fro in known manner. When all the needles are advanced they define a working region, running parallel to the needle beds 12 and arranged close above the knitting needles 13. The yarns have to be presented to this working region to the knitting needles, so that the needles grip the yarns and process them into stitches. Other details of the flat bed knitting machine, not essential for the closer understanding of the invention, can be derived for example, from the Dt. OLS Nos. 25 31 762, 25 31 705 and U.S. Pat. No. 4,109,491.

Above the machine, provision is made for a stationary and preferably parallel to the working region, eyelet carrier 14 through the eyelets 15 of which, several yarns 16 are fed from stationary supply packages to a number of threads guides or feeding elements 19 with laying-in elements, in the form of eyelets 21, and above this eyelet carrier 14, a storage means 17 is indicated for each yarn 16, the said storage means 17 serving as an intermediate storage for the yarn segments released during the return motion of the feeding elements 19.

As transport for the feeding elements 19, an endless, round, rotary track 50 is provided, having a working section 51 and a return section 52, such that the working section 51 lies above the working region of the laying-in elements 21. The return section 52 is arranged between the working section 51 and the eyelet carrier 14. The rotary track 50 is formed by an endless, flexible belt 53 on which the feeding elements 19 are attached, and defined by two deflection wheels 54 and 55, the axes of which are mounted on the ends of the rigid rail 27. In order to achieve that the yarns 16, during the repeated rotation of the feeding elements in the direction of an arrow R, are alternately arranged on the one and on the other broad side of the rotary track 50, and that as a consequence, they do not become entwined, two guide rails 57 and 58 forming a run-in funnel and a shunt 59 are provided, which are connected with two electromagnets 60, connected with a control mechanism by means of cables (not illustrated), the said shunt 59 being switched in this manner from the position shown by a full line in FIG. 1, to the position indicated by a broken line, and vice versa. The shunt 59 has two guide rails 42 attached to it, which take over the yarns 16 distributed by the shunt 59, to the one or other broad side of the rotary track 50 and transfer to a guide trail 41, thereby ensuring that the yarns do not come into contact with any parts of the yarn guiding/feeding means or with the knitting machine.

In order that the deflection of the yarns is not hampered by the supports to the rotary track 50, a support system 61 and 62 is provided on each end of the rotary track 50, this support system offering a suspended bearing for the perimeters of the deflector rolls 54 and 55. Each support system 61 and 62 comprises 4 support rollers 63,64,65 and 66, which are mounted externally of the track 50 in a framework (not illustrated). The support system 61 would preferably also serve as the drive for the belt 53, carrying the feeding elements 19. To this end, a belt 67 encompasses the support rollers 63 to 66, and the belt 67 is in contact peripherally with the deflector rollers 54 and 55, and supports and drives the latter. The belt 67 is preferably toothed on its inside and on its outside surfaces this toothing engaging in corresponding toothing on the exterior of the support rollers 63 to 66 and with the toothing on the deflector rolls 54 and 55, thereby making slippage of the belt 67 impossible. The support roller 63 is connected with a drive means, which has another wheel 69, attached to the shaft 68 of the support roller 63. The wheel 69 is coupled by means of a belt 70 or the like, with the drive wheel of a drive motor.

Figure 2:
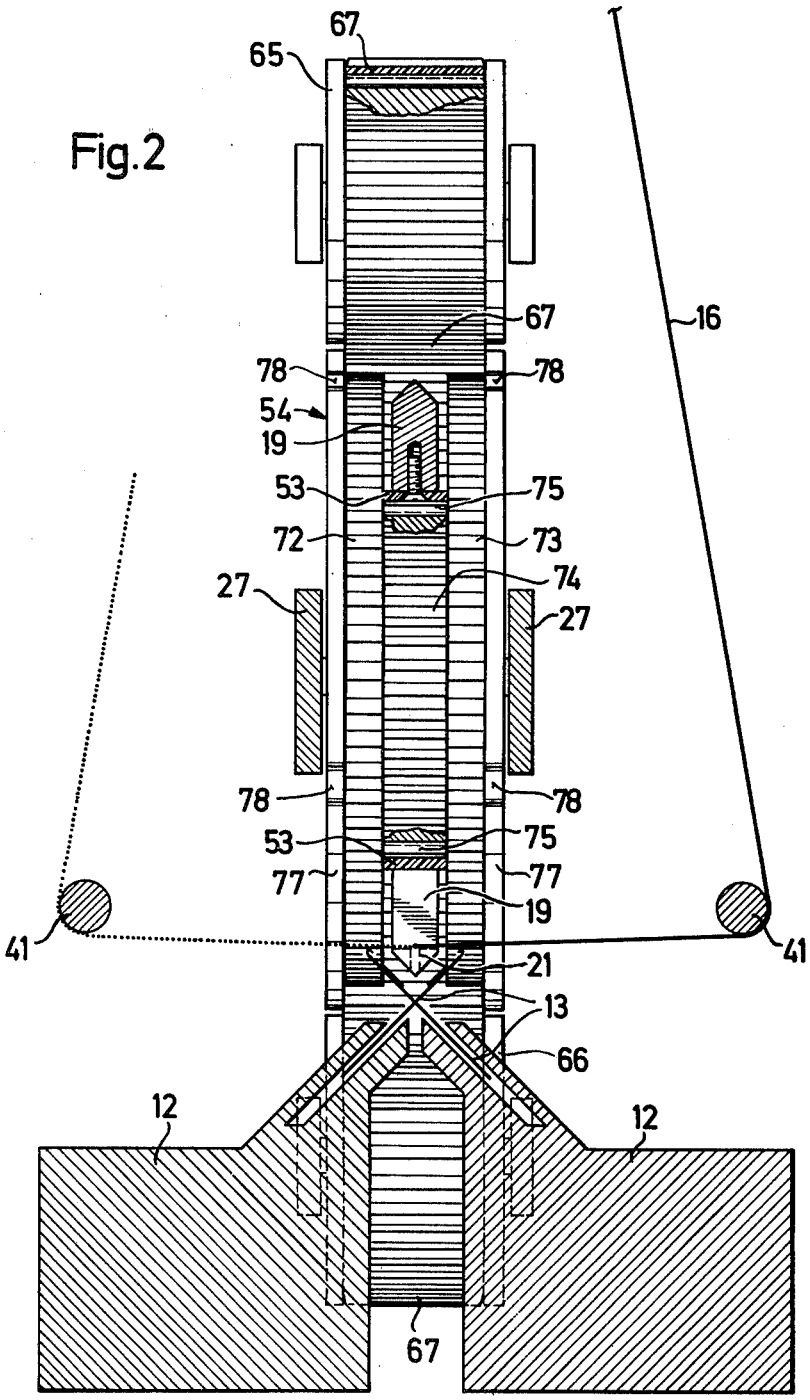
FIG. 2 shows the section along the line II—II of FIG. 1.

The design of the deflector wheels 54 and 55 can be seen in FIG. 2. Each deflector wheel consists of two circular discs 72 and 73, about the circumference of which the belt 67 runs, and between which, a coaxial drive wheel 74 for the feeding elements 19 is fitted. A belt 53 runs on this drive wheel 74. Suitable toothing 75 can be provided on the outer circumference of the drive wheel 74 and on the inside of the belt 53, in order to prevent slippage of the belt 53. The outside diameter of the drive wheel 74 is smaller than the outside diameter of the circular discs 72 and 73, so that the feeding elements 19, when passing the deflection wheels 54 and 55 according to FIG. 2, can be accommodated in the space between the peripheral lines of the circular discs 72 and 73 and the drive wheels 74.

To avoid damage to the yarns 16 after they have been deflected by the shunt 59 to the one or other side of the rotary track 50 and transferred on to the guide rails 42 or 41 during the time the relevant feeding elements 19 pass the deflection wheels 54 and 55, radial slots are provided in the external circumference of the circular discs 72 and 73. Corresponding radial slots 78 (FIG. 1) are provided in flanged discs 77, which are fitted coaxially to the two outer sides of the circular discs 72 and 73, and have a somewhat larger diameter than these, in order to prevent the belt 67 slipping off the circular discs 72, 73.

The operation of the yarn guiding system according to FIGS. 1 and 2 is as follows: During the repeated rotation of the feeding elements 19, the yarns 16 are cut at the end of the working region by means of a cutting device 18 and by means of clamping devices, which are arranged in the feeding elements (19), the yarns are clamped. The clamped yarn ends are conveyed back to the start of the working region and at that point they are released from the clamps. Each yarn 16, on completion of a revolution of the belt 53, reaches the shunt once, and is deflected by this shunt 59 alternately to the one or other side of the rotary track 50, thereby avoiding entwining of the yarns 16.

Figure 3:
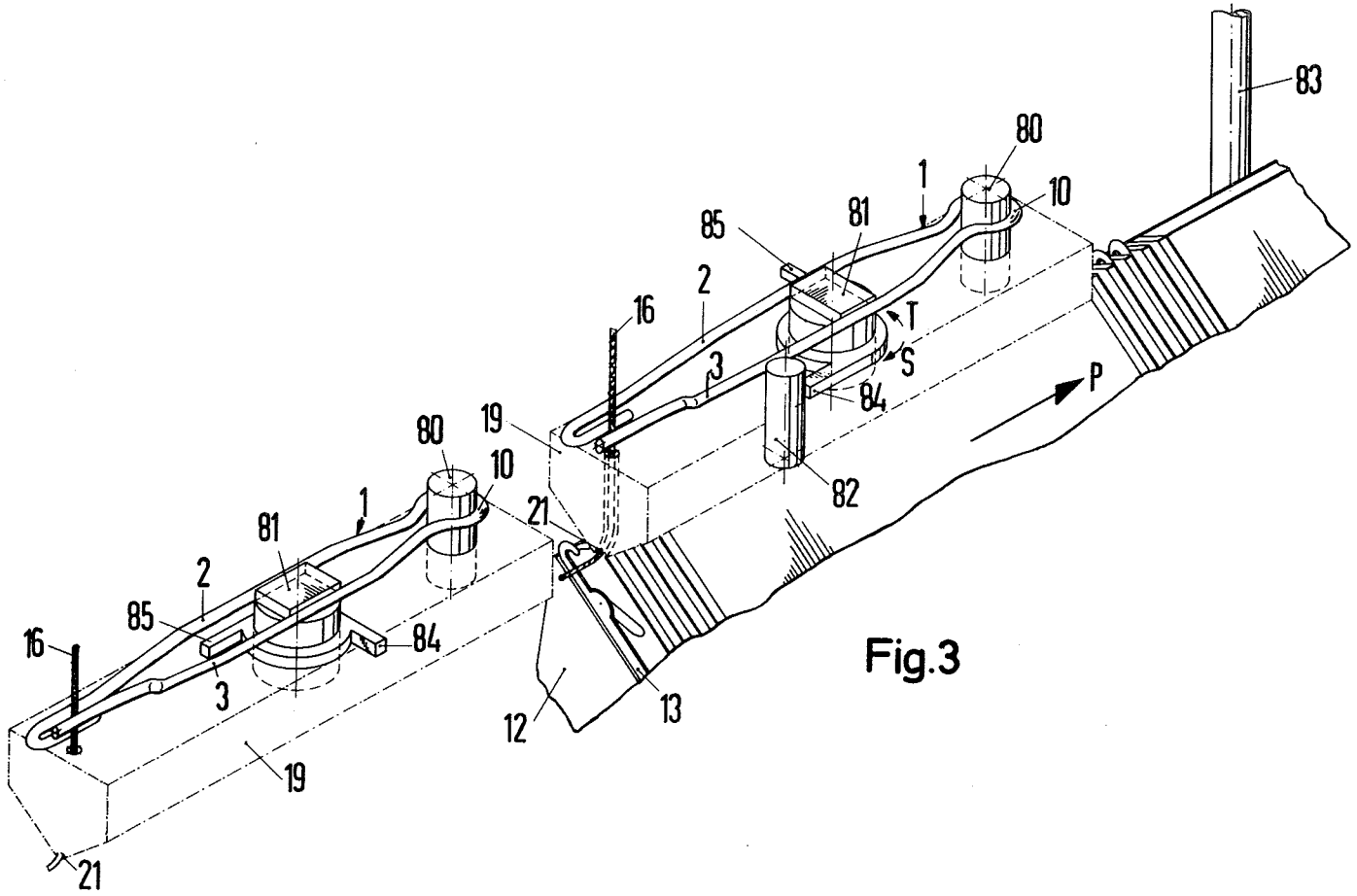
FIG. 3 shows feeding element with a clamp device, for the knitting machine according to the FIGS. 1 and 2.

To clamp the yarns 16, as shown in FIG. 3, each feeding element 19 has a clamp 1 attached to it via a bearing pin 80 in the form of an eyelet-type bend 10 and extends parallel to the running direction of the feeding element 19, indicated by the arrow P. To open and close the clamp 1, opening and closing mechanisms are provided, consisting of cams 81, arranged on every feeding element 19, rotatably mounted between the arms 2 and 3 and consisting also of indexing pegs 82 and 83, at the start and end of the working region, such that when viewed in the direction of the arrow P, the indexing peg 82 is fitted on the right and the indexing peg 83 is fitted on the left of the yarn guides. The indexing peg 81 has a rectangular cross section and the two arms 2 and 3 of the clamp 1 are mutually so pre-tensioned, that in the position of the indexing peg 81, in which it rests on both its long sides so that the two arms are in clamping position by virtue of the pre-tensioning, as shown on the left in FIG. 3, whereas in the position of the indexing peg 81, shown on the right hand side of FIG. 3, and in which it rests on its two shorter sides, the two arms 2 and 3 are held in the open positions, counter to the pre-tensioning.

According to FIG. 3, beneath the indexing peg 81, two tripping arms 84 and 85 are fitted so as to form an angle of 90°. Thus, if one feeding element (e.g. the one shown on the left in FIG. 3) approaches the working region, then the relevant clamping device 1 will be in the clamping position, and the tripping arm 84 will protrude at right angles towards the front right, so that the indexing cam 81, when the tripping arm 84 strikes against the indexing peg 82, is turned through 90° in the direction of the arrow S and the clamping device 1 is moved to the open position. This open position, seen on the right in FIG. 3, is assumed by the clamping device 1 as long as it is being fed through the working region, so that the yarn 16 can be laid-into the knitting needles 13, the as it is is being withdrawn from the supply package and can be processed into stitches. At the end of the working region, the tripping arm 85, which now protrudes outwards to the left (or to the back), strikes against the indexing peg 83, whereupon the indexing cam 81 returns in the direction of the arrow T, turning through 90°, and the clamping device 1 is returned to the clamping position shown in the left hand side of FIG. 3. In this position of the clamping device 1, the yarn end held by the cutting device 18, together with the relevant feeding element 19, is returned along the return region to the working region.

Figure 4:
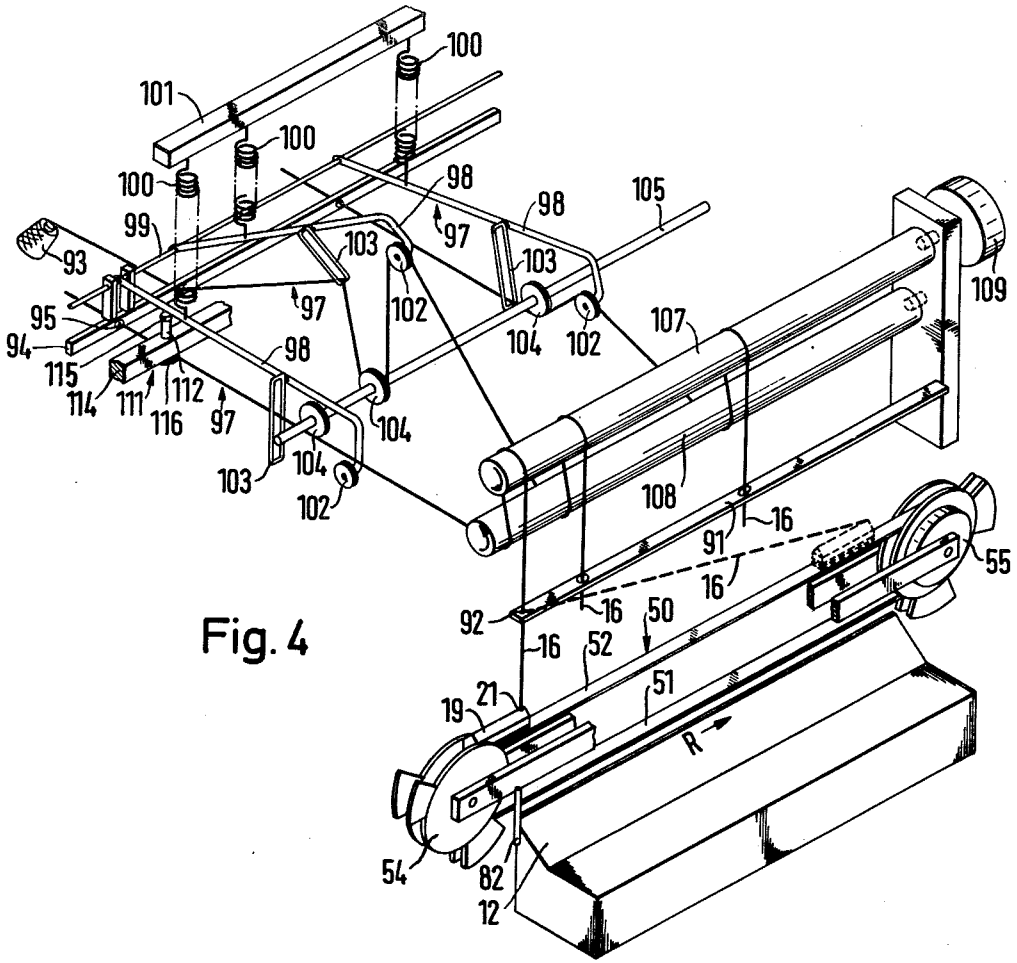
FIG. 4 is a schematic diagram in perspective of a storage device according to the invention.

According to the schematically illustrated knitting machine with the needle beds 12, the rotary track 50, the deflection wheels 54 and 55, and the indexing pegs 82 seen in FIG. 4 there is a fixed, stationary eyelet support 91 with eyelets 92, through which the yarns 16 are fed to the feeding element 19. Another eyelet support 94 with eyelets 95, located stationary in front of a number of stationary supply packages 93, serves to guide the yarn 16 to the eyelets 92.

Between the two eyelet supports 91 and 94 there is a number of storage means 97 according to the invention and corresponding in number to the number of yarns 16. Each storage device comprises a rocking lever 98, the one end of which is pivotly mounted on a fixed shaft 99 and is pre-tensioned by a force. According to FIG. 4, this force is applied by a coil spring 100, the one end of which is attached to a middle section of the lever 98 and the other end is attached to a fixed beam 101, arranged parallel to the axis 99, such that the spring 100 tends to pull the lever 98 in FIG. 4, upwards.

On the free end of the lever 98 is rotatably mounted a guide element in the form of a roller 102, for the yarn 16. The roller surface has a groove running round it to provide a more positive guide for the yarn 16. Between the roller 102 and the shaft 99, provision is made for a yarn guide 103 in the form of an elongated eyelet 103 and attached to the lever 98. The yarn 16 is passed through this eyelet 103 in the position of the lever 98 shown in FIG. 4, almost without friction. Between the eyelet 103 and the roller 102 there is finally yet another guide for the yarn 16, this guide being in the form of another roller 104, which is rotatably mounted on a stationary shaft 105 arranged parallel to the shaft 99. The shaft 105 also carries corresponding rollers 104 for the other yarns. The other rollers 104 are also grooved around their surface to provide a better and more positive guide for the yarns 16.

Between the roller 102 and the eyelet support 91, two feed rolls 107 and 108 are rotatably mounted, and form the outlet from the storage devices 97 and are driven by means of a motor 109, via a gearing (not illustrated) at the same speed, such that they rotate in opposite directions as indicated by the arrows. The feed rolls 107 and 108 are of known type, operating with slippage (U.S. Pat. No. 3,039,330), the length of the feed roles 107 and 108 is sufficiently great in the axial direction, that they can simultaneously propel all the yarns 16 fed to the machine, according to FIG. 4.

Figure 5:
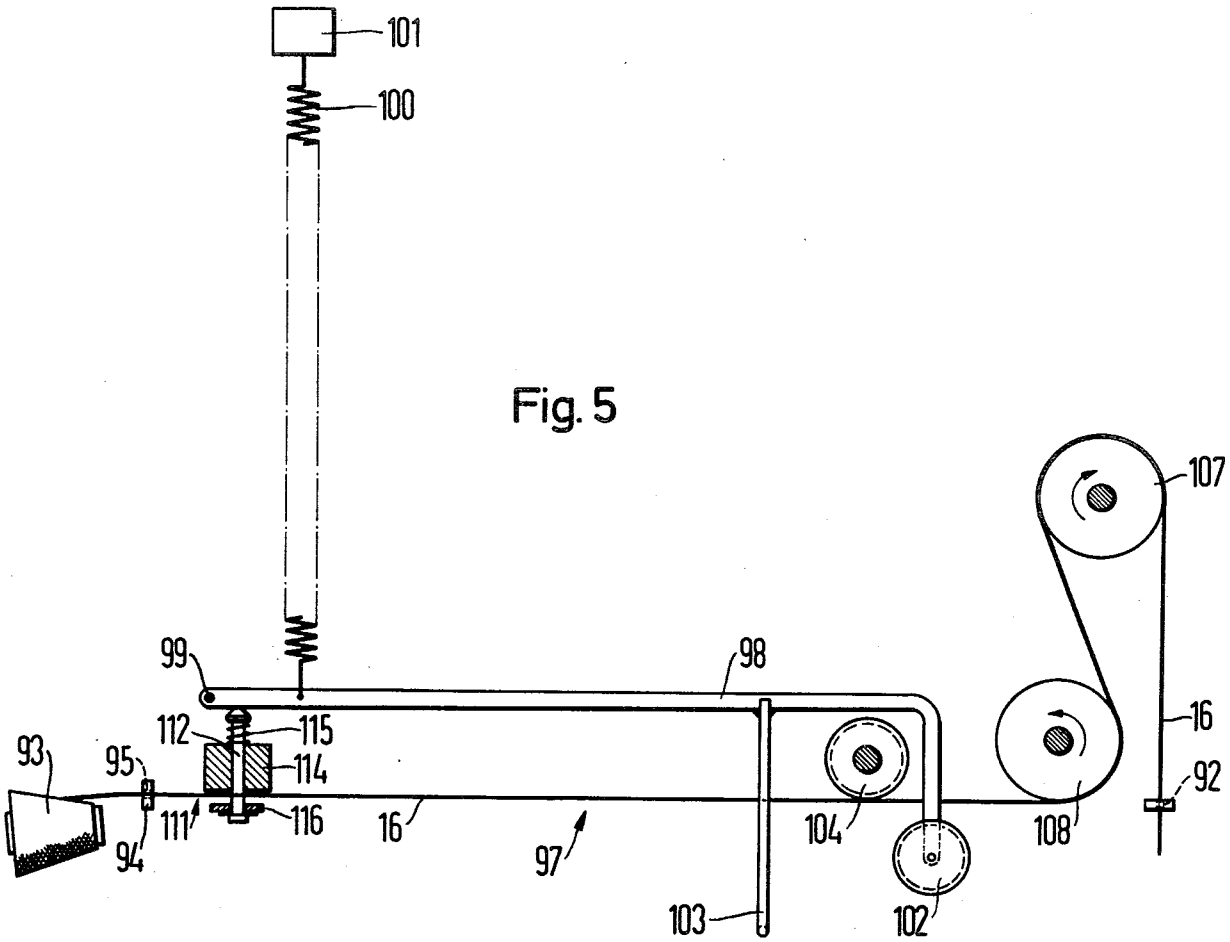
FIGS. 5 to 7 are side views of the storage device according to FIG. 4, in a yarn-laying position, in a through-run position and in a storage position.

According to FIGS. 4 and 5, between the eyelets 95 and 103, provision is made for a corresponding number of clamps 111 for each yarn 16. This clamp forms the entry to the storage device 97 and embodies an indexing finger 112 resting against the lever 98 and which is supported on a fixed beam 114 extending parallel to the eyelet support 94 and which can be moved to and fro in the tilting plane of the layer 98. As clearly shown in FIG. 5, the indexing finger 112 is pressed against the lever 98 by a thrust spring 115, supported on the beam 114. On the other end of the indexing finger 112, protruding from the beam 114, a clamp plate 116 is fitted at such a distance from the clamp beam 114 that the yarn, fed between the clamp beam 114 and the clamp plate 116, can be drawn free from the position shown in FIGS. 4 and 5, and yet the yarn is clamped as soon as the lever 98 is tilted through a certain angle above the shaft 99, and as a result, the clamp plate 116 is pressed against the clamp beam 114 under the influence of the thrust spring 115.

Figure 6:
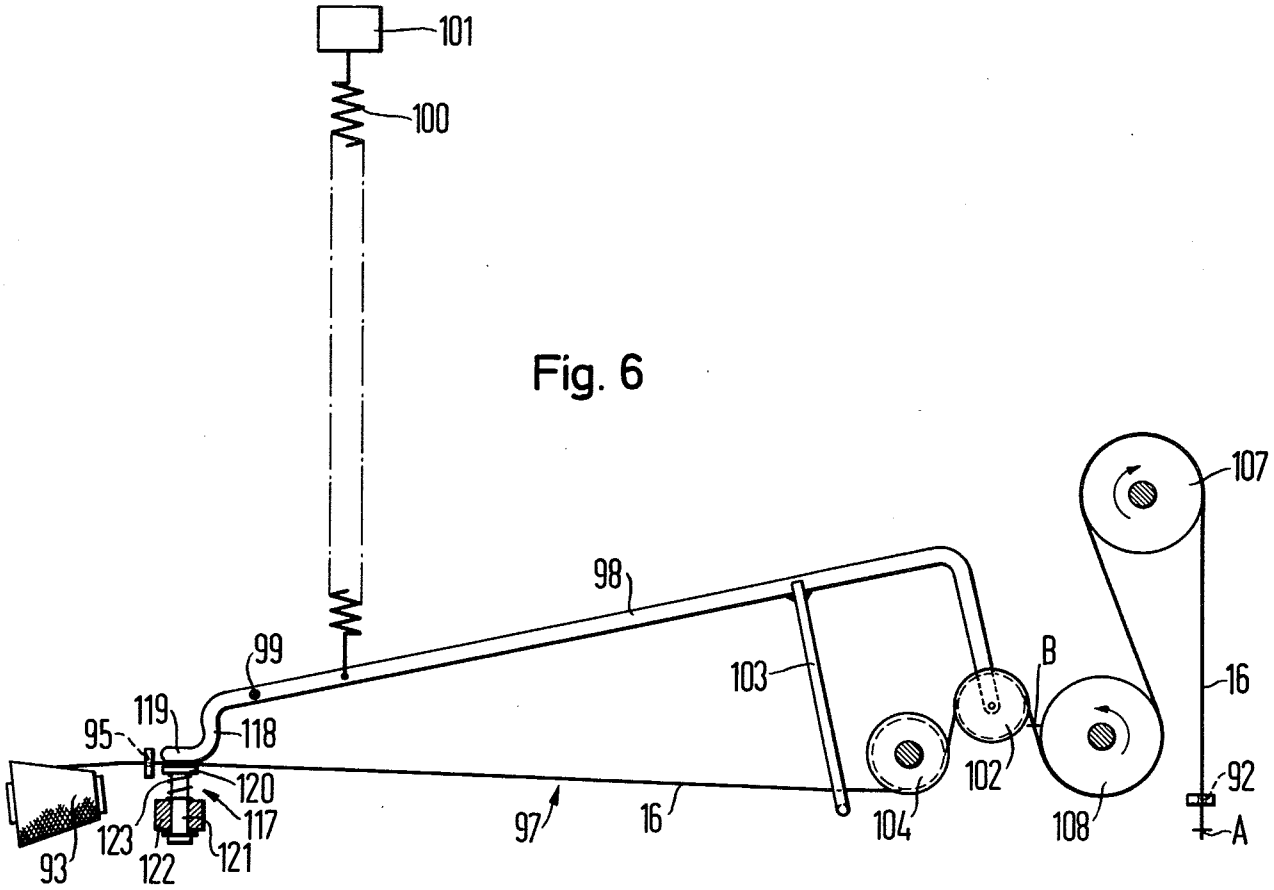

In the embodiment shown in FIG. 6, provision is made for a clamp 117, having an indexing finger 118 with a clamp plate 119, said finger 118 being located at the end of the lever 98. Opposite the clamp plate 119 is a clamp plate 120 which is attached to one end of a pin 121, which is in a sliding mounting on a fixed beam 122 extending parallel to the axis 99 and pre-tensioned by a compression spring 123 in the direction of the clamp plate 119, such that the yarn 16 is clamped when fed between the two clamp plates 119 and 120, as soon as the lever 98 is tilted about a given angle about the axis 99.

Figure 7:
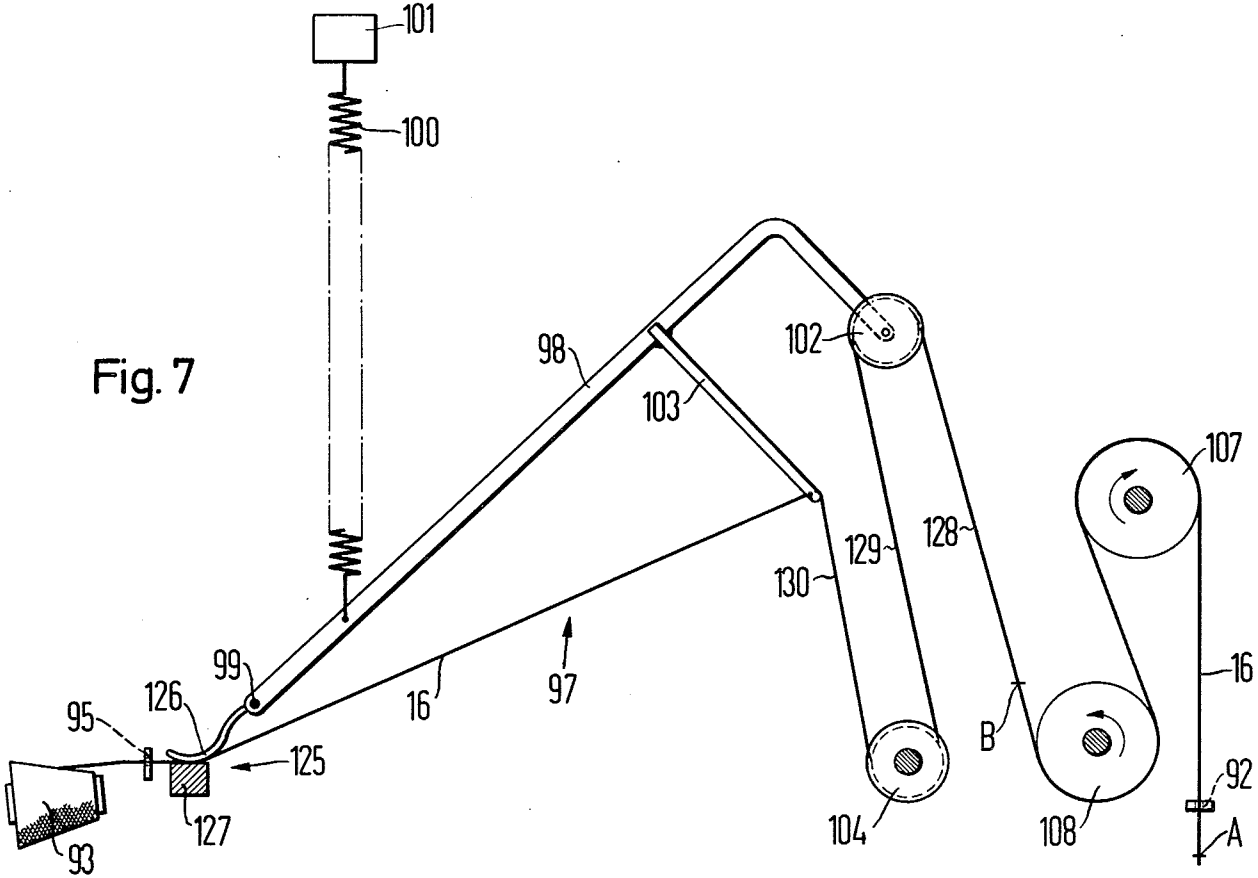

In the embodiment shown in FIG. 7, provision is made for a clamp 125, consisting only of an indexing finger 126 (resilient if required) located at the end of the lever 98, and a clamping beam 127, arranged parallel to the axis 99. In the case, the indexing finger 126 is curved such that in the position of the lever 98, shown in FIG. 7, the yarn 16 is clamped, although the yarn is released as soon as the lever 98 tilts back to the position indicated in FIG. 6.

The eyelets 92 and 95, yarn guides 102, 103 and 104, clamping devices 112 and feed mechanisms 107 and 108, associated with every yarn 16, are arranged essentially on one plane, so that the yarns are conveyed on an essentially parallel plane between the two eyelet carriers 91 and 94.

During the continuous rotation of any feeding element 19 on the track 50, there is a constant change in distance between the relevant laying-in element 21 and the corresponding eyelet 92 of the eyelet carrier 91. In the absence of the storage devices 97, the distance between the elements 21, and the supply packages 93 could also alter continuously if said distance is defined by a linear section leading from 93 through the eyelets 95 and 92 to the elements 21. Also said distance would be a function of the prevailing position of the yarn guides and the slots 78. It is also seen from FIG. 4 by the slots 78 and by the feeding element 19. It is also seen from FIG. 4 that this distance, for example, for the extreme left yarn 16, is relatively short when the relevant feeding element 19 is in the extreme left position, indicated by the full line, whereas the distance is relatively long, when the same feeding element 19 is in the extreme right position, indicated by the broken line. If the indicated feeding element 19 moves, for example, on the top return section 52, from right to left, while at the same time, the end of the corresponding yarn 16 is held clamped and no yarn is used up by this knitting machine, then the distance from the laying-in element 21 to the eyelet 92 first becomes progressively shorter, which means that the yarn section between the laying-in element 21 and the eyelet 92 tends to sag loosely and is no longer under control, until either the feeding element 19 has been moved so far to the left, that the distance between the laying-in element 21 and the eyelet 92 again corresponds to the length of the fed yarn section, or until the yarn end being guided by the feeding element 19 is released again, and so much yarn has been processed by the knitting needles into stitches that the yarn between the laying-in element 21 and the eyelet 92 is again taut. The same applies to all the other feeding elements 19, depending of course on which eyelet 92 of the eyelet carrier 91 the relevant yarns 16 are associated with.

To avoid that the yarns 16 are fed in controlled manner and are hanging slack during the said time when the distance is diminishing, for every yarn, a storage device 17 is provided in the form of a spiral spring as shown in FIG. 1, the spiral spring having at its free end, a guide eyelet for the yarn, said eyelet being displaced correspondingly in the event of a reduction in distance. Such storage means are generally inadequate to compensate distance changes of a meter or more on machines of the described type. For this reason, between each eyelet 92 and the associated eyelet 95, a storage device 97, according to the invention, is provided according to FIGS. 4 to 7, the mode of operation of which is described below.

FIG. 5 shows the laying-in position of the storage device 97, i.e. the position in which the yarn 16 is laid into the various guide elements. This position is achieved by the operator presses down the lever 98 against the pressure of the coil spring 100. The yarn 16 is then withdrawn from the supply package 93, fed through the eyelets 95 and 103, then wrapped about the roller 104 from below, about the roller 102 from above, about the feed roller 108 from below and about the feed roller 107 from above and finally drawn through the eyelet 92 to the knitting machine, laid into a feeding element 19 and held there by means of the clamping device 1. The operator then releases the lever 98 so that it is drawn by the coil spring 100 into the open position, shown in FIG. 6, or according to FIG. 7, into a storage position, depending on the length of the laid-in yarn section. Thereafter, the feed rolls 107 and 108 and the knitting machine are switched on, so that the feeding elements 19 rotate continuously around the track 50.

When a feeding element 19 is in the working region 51, the relevant yarn 16 is normally released so that the yarn 16 is processed into stitches by the knitting needles, and for this purpose, the yarn is withdrawn from the relevant supply package 93 in association with the feed rolls 107 and 108. As a result, the lever 98 assumes the equilibrium position shown in FIG. 6, in which the clamping element 111 or 117 or 125 is opened. In the event of irregularities in the yarn being fed, the case should arise that the lever 98 is raised too severely by the coil spring and consequently, additional yarn is also withdrawn from the supply package 93, the clamping element 111, 117 or 125 is closed automatically and immediately and thus no more yarn is withdrawn from the supply package 93 until the yarn section intermediately stored through the lifting of the lever 98 is released again and consequently, the lever 98 has again been tilted into the position shown in FIG. 6, when the clamp element 111, 117 or 125 is opened again. A similar situation would arise if the yarn tension on the side nearest the machine were to become so small for a short period of time for some reason that the coil spring 100 pulls the lever 98 upwards.

When one of the feeding elements 19 reaches the end of the working region 51, the yarn 16 it feeds is severed and the yarn end is clamped. Thereafter, the distance of this feeding element 19 from the relevant eyelet 92 will usually reduce, because the feeding element 19 is deflected by the deflection wheel 55 on to the return region 52, with the result that the yarn tension progressively decreases and the force exerted on the yarn 16 from the direction of this feeding element 19, becomes smaller than the force exerted by the coil spring 100 when in the state of equilibrium. Consequently, the lever 98 is lifted by the coil spring 100, for example, into the position shown in FIG. 7, in which the yarn section between the eyelet 92 and the feeding element 19 is again taut and thus the force exerted by the yarn guide on the lever 98 via the yarn, is again exactly the same as the force exerted by the coil spring 100 on the lever 98.

As long as the feeding element 19 moves in the manner that its distance from the eyelet 92 is reduced, the lever 98 will automatically be raised and continually moved through a number of storage positions, so that the guide elements 102, 103 and 104, arranged in the form of a block and tackle, will store ever larger yarn sections 128, 129 and 130, so that the eyelet 104 will also act as a deflection point. Immediately following the commencement of this process, the clamp 111 or 117 or 125 will also close automatically, so that during this process, no more yarn will be withdrawn from the supply package 93 and temporarily stored.

After the feeding element 19 in question, on its rotary track 50, reaches the position of its shortest distance from the eyelet 92, this distance is then again gradually increased during the further movement of the feeding element 19. As a result, the temporarily stored yarn sections 128, 129 and 130, in conjunction with the feed rolls 107 and 108, and with lowering of the lever 98 against the force of the coil spring 100, are withdrawn from the storage device 97, because the clamp element 111 or 117 or 125 is still closed. This process is continued until such time that the stored yarn sections 128, 129 and 130 are used up and the lever 98 is tilted back to the open position with the opening of clamping element 111, 117 or 125 shown in FIG. 6. When the temporarily stored yarn sections are used up, the yarn can then be drawn immediately from the supply package 93.

The described processes of intermediate storage of yarn sections and the subsequent release of these yarn sections before withdrawal of further yarn from the supply package, are repeated during the continuous rotation of the feeding elements 19 around the track 50, such that the lengths of the temporarily stored yarn sections 128, 129 and 130 depend on the prevailing position of the feeding element in question and on the position of the stationary eyelet 92 associated with it. In this, the automatic operation of the storage mechanisms 97 is independent of whether the reduced spacing achieved in the extreme case, is the same or different for all feeding elements 19, whether a yarn 16, when its feeding element 19 passes through the working region 51, is processed into stitches by all, by only a few or by none of the knitting needles and whether the temporarily stored yarn sections 128, 129 and 130 are already used up, when the relevant yarn feeder runs into the working region and is processed by the first knitting needle.

The two feed rolls 107 and 108 serve to maintain an essentially constant tension on the yarn when knitting at a position indicated by the letter A in FIGS. 6 and 7. When the feeding element 19 stops and in the event that the yarn 16 is jammed or held by the knitting needles, the storage device 97 is in equilibrium and despite the rotation by the feed rollers, no yarn is supplied. The yarn tension at a position marked B in FIGS. 6 and 7, then depends mainly on the force component of the coil spring 100, acting on the lever 98, and on the effective component of the weight of the lever 98, including the guide elements attached to it.

If a tension is applied to the yarn 16 at the position A when the machine is switched on, and this tension exceeds the equilibrium, due to a movement of the yarn guide or due to the working of the knitting needles, the yarns 16 will lie against the surfaces of the feed rolls 107 and 108 and will become conveyed by these to the knitting machine. With a constant relative speed between a yarn and the peripheral surface of the feed rolls 107 and 108 and with constant tension at the point B, the yarn tension at the point A will be smaller, the larger the angle of wrap at which the yarn rests on the feed rolls 107 and 108. With a constant angle of wrap and constant tension at the point B, the tension of the yarn 16 at A will however be smaller, the higher the relative speed between the yarn and the peripheral surface of the feed rolls 107 and 108.

With a constant angle of wrap and constant relative speed, the yarn tension at A will be reduced in a constant ratio relative to the tension at the point B. It follows therefore, that the feed rolls 107 and 108 act as force amplifiers, in so far as yarn is used up and withdrawn from the storage means 27 or from the supply package.

If on the other hand, the tension at point B is greater than at point A, for example, because the distance between the feeding element 19 and the eyelet 92 is reduced and no, or insufficient, yarn is used up, the lever 98 is automatically lifted by the coil spring 100, so that yarn sections 128, 129 and 130 of corresponding length are temporarily stored and the yarn is also held tensioned even between the eyelet 92 and the feeding element and fed in a controlled manner. The rotating feed rolls 107 and 108 do not hamper the intermediate storing, because the yarn 16, during this stage of operation, is not held under such a tension that it can rest on and be propelled by the surfaces of the feed rolls 107 and 108.

By using feed rolls 107 and 108, a position is achieved whereby changes in tension at the point B during the supply of yarn will affect the outcome only in the ratio determined by the increased force at the point A. This situation is extremely important, because the tension at point B, during the temporary storage of yarn sections 128, 129 and 130, fluctuates relatively strongly, due to the constantly changing effective components of the lever weight and the spring force and possibly, also due to the non-linearity of the spring force and could vary for example, by as much as 0.06 Newton. The result of this would be that the tension at the point A would fluctuate correspondingly, without the feed rolls, and this would not be acceptable for knitting reasons.

When using feed rolls 107 and 108, exerting a relatively small increased force, e.g. 6:1, the tension fluctuations would then be only 0.01 Newton.

Another advantage of the feed rolls 107 and 108 is that they cancel out even those tension fluctuations and inconsistencies which arise when the temporarily stored yarn sections 128, 129 and 130 are used up and then further yarn is withdrawn from the supply package 93. If the tensions induced by the withdrawl of yarns from the supply packages are too high, provision can be made for additional feed mechanisms, corresponding to the feed rolls 107 and 108, between the clamping elements 111, 117 and 125 and the supply packages 93.

Finally, the angles of wrap of the yarns about the feed rolls 107 and 108 and the relative speeds between the yarns and the peripheral surfaces of the feed rolls can be selected such that the tension produced at the point A would be smaller in any case than the tension required for knitting. In this case, every feeding element 19 could be associated with an additional yarn tensioner, to set the yarn tension to the value required for each individual case, so that the tension fluctuations caused by the intermediate storage of the yarns, would have no influence whatsoever on the tension desired for knitting.

With regard to the yarn path within the storage mechanisms 97, in the form of a set of pulleys, it should be noted that when using only one roller, e.g. the roller 102, the force of the coil spring 100 has to be roughly the same as the equilibrium force desired at the point B. However, if several rollers are used, e.g. rollers 102 and 103, and possibly the eyelet 103 (FIG. 7) in the case of intermediate storage, so that three yarn sections 128, 129 and 130 are formed, then the force of the coil spring 100 must be three times as great as the desired equilibrium force at the position B.

With a length of lever 98 about 30 cm, the storage device illustrated in FIGS. 4 to 7, would enable intermediate storage of yarn lengths of a total of about 90 cm, using coil springs 100, which is still essentially linear. For storing longer yarn lengths, it is advisable to supplement the pulley system with additional rollers and eyelets, in which case, it would be necessary to provide for much stronger coil springs 100.

The invention is not confined to the embodiment examples described, since these can be modified in a number of ways. Moreover, the storage device according to the invention is not limited to use on the knitting machines described in conjunction with FIGS. 1 and 2, but can in fact be used with other known knitting and warp knitting machines (Dt. Pat. No. 20 64 227 or Dt. OLS No. 23 51 741) as well as with machines on which the same problems arise with respect to yarn guiding. Moreover, it is not essential to transport the feeding elements on a single rotary track 50; in fact, several such rotary tracks may be provided and even separate rotary tracks for the feeding elements and/or the clamp elements 1 and/or the laying-in elements 21. The expression "feeding element" is therefore to be understood in its broadest sense and includes yarn guides, clamping elements, guide eyelets and guide rolls, so that it is possible during the guidance of a single yarn to utilize several guide elements are provided for alternately guiding/feeding the yarn. The above definition for the distance between the supply packages and the feeding elements also includes such cases, in which no specific eyelet carrier or instead of the eyelet carrier, other deflection points are provided. The apparatus according to the invention can also be used for feeding sliver and fibrillar material and for feeding other than textile materials.

The feed mechanism, consisting of two feed rolls 107 and 108, may be substituted by other feed mechanisms or by feed mechanisms with less or more than two feed rolls, since the number of feed rolls used in any particular case depends essentially, only on the desired overall angle of wrap. Moreover, feed rolls may be used, with surfaces having protrusions running in axial direction or in the form of spirals, for preventing the adhesion of the yarns. Instead of one continuous feed roll for all yarns, separate feed rolls can be provided for each yarn.

The design of the described clamping device and its arrangement, is freely selectable, providing it undertakes the same function with the described apparatus. The same applies to the tension/compression springs 100, which may be replaced by other springs. Instead of springs, other elements may be used to exert the same effect.

We claim:

1. Apparatus for feeding a plurality of yarn, sliver or fibrous materials (16) to a plurality of processing elements in a a textile machine, comprising: a plurality of stationary supply packages (93) on which said materials (16) are wound; a stationary endless track (50) having at least a working and a return section (51,52); a plurality of feeding elements (21) associated with said processing elements, every feeding element (21) being associated with one of said supply packages (93), wherein said feeding elements (21) are arranged to run around said track (50) in series in such a manner, that the distances between the feeding elements (21) and the associated ones of said supply packages (93) become gradually and alternately smaller and larger during successive runs of said feeding elements (21) on said track (50), and wherein said materials (16) are held by said feeding elements (21) when the relevant feeding elements (21) pass through said return section (52), and are releasable for processing by said textile machine when the relevant feeding elements (21) pass through said working section (51); a plurality of automatically operating and stationary storage means (17,97) arranged in the path between the said feeding elements (21) and the associated supply packages (93) for the intermediate storage of all quantities of the materials (16) which may result from a reduction of the distance between a feeding element (21) and the associated supply package (93), and for the delivery of said stored quantities, if said distances again become gradually larger; and means for avoiding entwining of the materials during successive runs of said feeding elements (21) on said track (50).

2. Apparatus according to claim 1, wherein the storage means (97) are so designed that the amounts of material which are stored in said storage means (97) are released automatically before the withdrawal of further material (16) from the relevant supply package (93) when a reduction of said distance is followed by an increase of said distance.

3. Apparatus according to claim 2, wherein at the entries to the storage means (97) on the side of the supply packages (93), provision is made for a clamping device (111,117,125), which can be actuated automatically into a clamping position, shortly after the commencement of an intermediate storage, for the purpose of interrupting the withdrawal of material (16) from the relevant supply package (93) and can be actuated automatically into an open position shortly before completion of the release of the intermediately stored material (16) taking place during the subsequent increase in said distance.

4. Apparatus according to claim 3, wherein each storage means (97) includes a lever (98) being held under the influence of a force, supporting at least one guide element (102) for the material, (16) said lever (98) normally being held by the material (16) against said force in an open position whereas in the event of a reduction in distance, is gradually tilted by said force into a storage position which corresponds to the minimum distance between the guide element and the supply package and during the subsequent increase in distance, is again gradually tilted against said force into the open position.

5. Apparatus according to claim 4, wherein the lever (98) is under pressure applied by a compression spring (100).

6. Apparatus according to claim 4, wherein the lever (98) is associated with an indexing finger (112,118,126) for tripping the clamping device (111,117,125) depending on its pivot position.

7. Apparatus according to claim 4, wherein the material (16) is wrapped around the guide element (102) and at least a second, rigidly mounted guide element (104) in the form of a tackle block.

8. Apparatus according to claim 7, wherein on the lever (98), at least a third guide element (103) for the material (16) is provided, and that the second guide element (104) is arranged in the form of a tackle block between the two guide elements (102, 103) mounted on the lever (98).

9. Apparatus according to claim 8, wherein the third guide element (103) comprises an eyelet, through which the material (16) passes without deflection in the open position of the lever (98), and which, when the lever (98) is in the storage position, induces a further deflection of the material (16) in the form of a tackle block.

10. Apparatus according to claim 1, wherein each storage means (97) embodies a system of guide elements in the form of a pulley system (102, 103, 104) about which the material (16) is laid, and that at least one guide element (102) is under the influence of a force.

11. Apparatus according to claim 10, wherein the guide elements (102,104) consist of freely rotating, mounted rollers.

12. Apparatus according to claim 10, wherein the force is spring force.

13. Apparatus according to claim 1, wherein at outlets of the storage means (97) at the side of said feeding elements (21), provision is made for a feed mechanism (107,108), by means of which the material tensions at the feeding elements (21) can be held essentially constant both during the withdrawal of the material from the storage means (97) and during withdrawal of the material from the supply packages.

14. Apparatus according to claim 13, wherein the feed mechanism (107, 108) consists of continuously rotating feed rollers.

15. Apparatus according to claim 13, wherein the feed mechanism (107,108) consists each of two feed rolls, continuously rotating in opposite directions.

16. Apparatus according to claim 13, wherein the feed mechanism (107,108) comprise more than two constantly rotating feed rollers.

17. Apparatus according to claim 1, wherein at least one cutting device (18) is provided for severing those materials (16) whose feeding elements (21) have reached the end of the working section (51), and said feeding elements (21) having clamping means (1) to clamp the material ends resulting from said severing operations.

18. A knitting machine having knitting needles (13) and an apparatus for feeding a plurality of threads (16) to said knitting needles (13), said apparatus comprising: a plurality of stationary supply packages (93) on which the threads (16) are wound; a stationary endless track (50) having at least a working section and a return section (51, 52); a plurality of thread guides (21), every thread guide (21) being associated with one of said supply packages (93), wherein said thread guides (21)

are arranged to run around said track (50) in series in such a manner that the distances between the thread guides (21) and the associated supply packages (93) become gradually and alternately larger and smaller during successive runs of said thread guides (21) on said track (50), and said thread guides (21) having clamping elements (1) which may be controlled for clamping said materials (16) when the relevant thread guides (21) pass through said return section (52) and for releasing said materials (16) for processing by said knitting machine when the relevant thread guides (21) pass through said working section (51); a plurality of automatically and stationary storage means (17, 97) arranged in the paths between said thread guides (21) and said associated supply packages (93) for the intermediate storage of all quantities of said threads (16) which may result from a reduction of the distance between a thread guide (21) and the associated supply package (93) and for the delivery of said stored quantities, if said distances again become gradually larger; and means for avoiding entwining of the materials (16) during successive runs of said thread guides (21) on said track (50).

* * * * *